United States Patent [19]

Doiron et al.

[11] 4,378,038

[45] Mar. 29, 1983

[54] PORTABLE HYDRAULIC LOG SPLITTER

[75] Inventors: Joseph A. Doiron, Southwick; Friedolf Kamila, Longmeadow, both of Mass.

[73] Assignee: Taylor Rental Corporation, Springfield, Mass.

[21] Appl. No.: 264,104

[22] Filed: May 14, 1981

[51] Int. Cl.[3] ..... B27L 7/00

[52] U.S. Cl. ..... 144/193 A; 144/366; 417/234

[58] Field of Search ..... 417/234; 144/193 R, 144/193 A, 366

[56] References Cited

U.S. PATENT DOCUMENTS

| | | | |
|---|---|---|---|
| 4,077,747 | 3/1978 | Burenga | 417/234 |
| 4,236,556 | 12/1980 | Smith | 144/193 A |
| 4,285,374 | 8/1981 | Klingel | 144/193 A |
| 4,293,013 | 10/1981 | Phelps et al. | 144/193 A |

*Primary Examiner*—W. D. Bray

*Attorney, Agent, or Firm*—Chapin, Neal, Dempsey, Fishman & Dionne

[57] ABSTRACT

A portable log splitting machine is disclosed wherein the splitter can be readily broken down into separate lightweight components for convenient transport and storage, such as in the trunk of an automobile. The splitter includes a ram section comprising an elongated beam with a wedge fitted at one end and a slidably-mounted pusher plate or ram which is hydraulically operated to drive a log against the wedge to split the same. The ram is reciprocably moved by the piston rod of a double-acting hydraulic cylinder. The rod is detachably connected to the ram by a simple yoke and cross pin arrangement and the cylinder is detachably fitted onto the beam by a trunnion pin that extends from the cylinder and slips into brackets carried by the beam for ready assembly and disassembly. An engine-driven pump assembly is connected to the cylinder by two detachable hoses and provides the hydraulic pressure for the cylinder.

8 Claims, 6 Drawing Figures

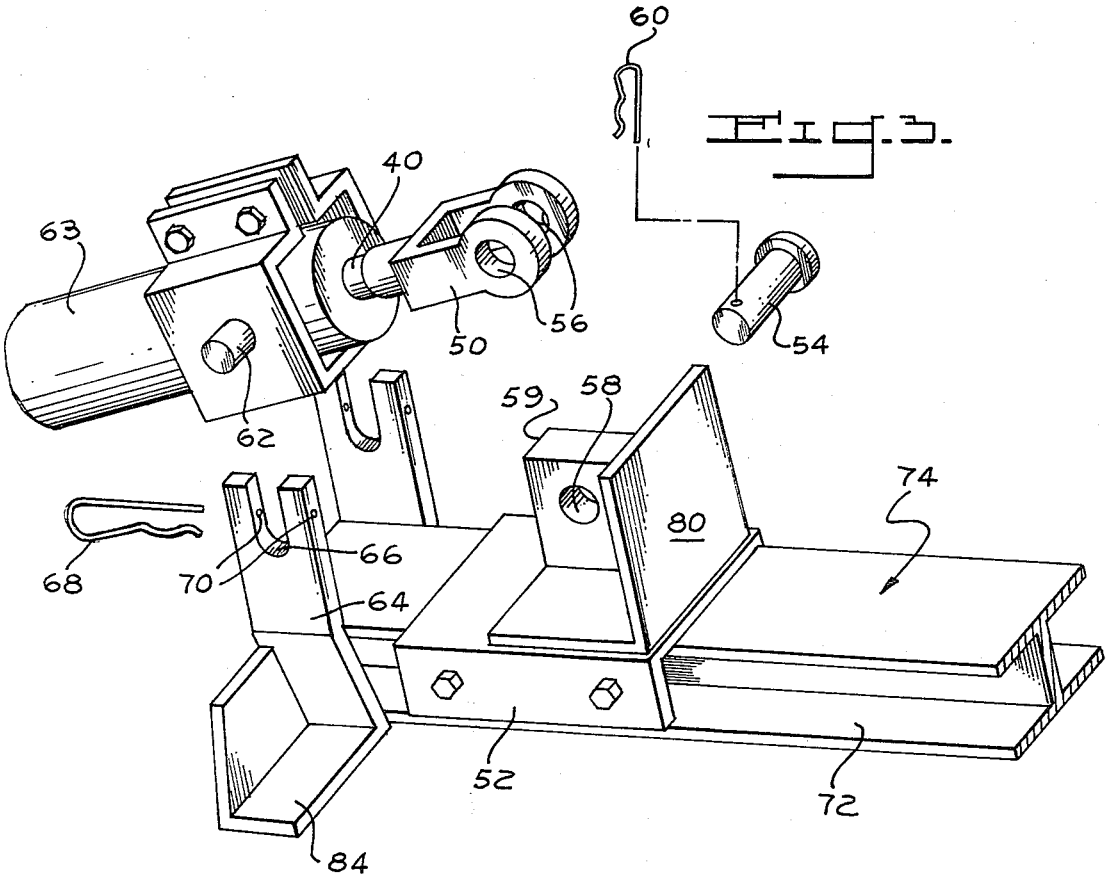
Fig. 3.
Fig. 4.
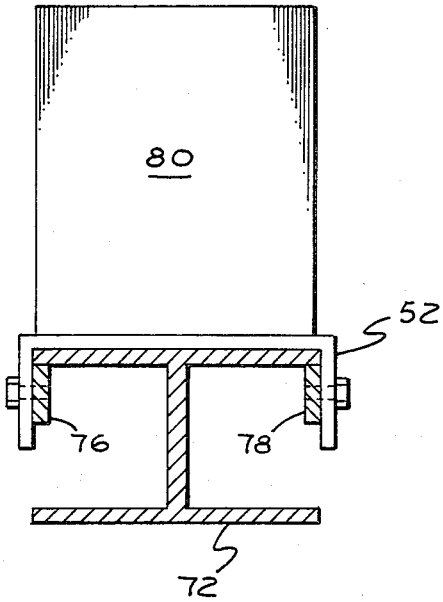

PORTABLE HYDRAULIC LOG SPLITTER

BACKGROUND OF THE INVENTION

This invention relates to machines for splitting firewood and more particularly relates to hydraulic log-splitting apparatus of the type that can be transported from place to place without a trailer vehicle.

In hydraulic log splitters, a log is usually supported on a frame lengthwise between a ram and a stationary splitting wedge. The ram is hydraulically operated to drive one end of the log against a sharp edge of the wedge. The wedge penetrates the log and, as the ram continues to move toward the wedge, the log is split lengthwise into two or more portions. U.S. Pat. Nos. 4,066,110 to Sarno, 4,076,062 to Kanik, 4,103,724 to Braid, 4,141,396 to McCallister, and 4,153,088 to King et al disclose splitters of this type.

Hydraulic splitters have generally been heavy, bulky and difficult to transport. While many have employed a trailer so that the splitter can be towed behind a vehicle, these units require additional equipment such as a towing hitch and are far from ideal for the average homeowner who desires to use an effective log splitter and may prefer to rent one for a day's use from an equipmental rental establishment.

Accordingly, it is the principal object of this invention to provide a transportable hydraulic log splitter adapted to be readily broken down into lightweight portable components for easy transport in most car trunks or station wagons, and is thus ideally suited for use in the equipment rental business.

It is another object to provide an effective and rugged log splitter which can be assembled and disassembled quickly and easily.

It is another object to provide a rugged hydraulic log splitter that is very easy for an inexperienced person to operate safely.

It is yet another object to provide a powerful log splitter that can be compactly transported and stored.

It is still another object to provide a transportable log splitter which, although simple and economical in construction, is durable and effective for heavy duty performance.

The above and other objects and advantages of this invention will become more readily apparent when the following description is read in conjunction with the accompanying drawings.

BRIEF DESCRIPTION OF THE DRAWINGS

FIG. 3 is a partial perspective view showing the cylinder and ram subassemblies positioned for assembly; and FIG. 4 is a cross-sectional view of the ram section taken along line 4—4 of FIG. 3.

DETAILED DESCRIPTION OF THE PREFERRED EMBODIMENT

Figure 1:
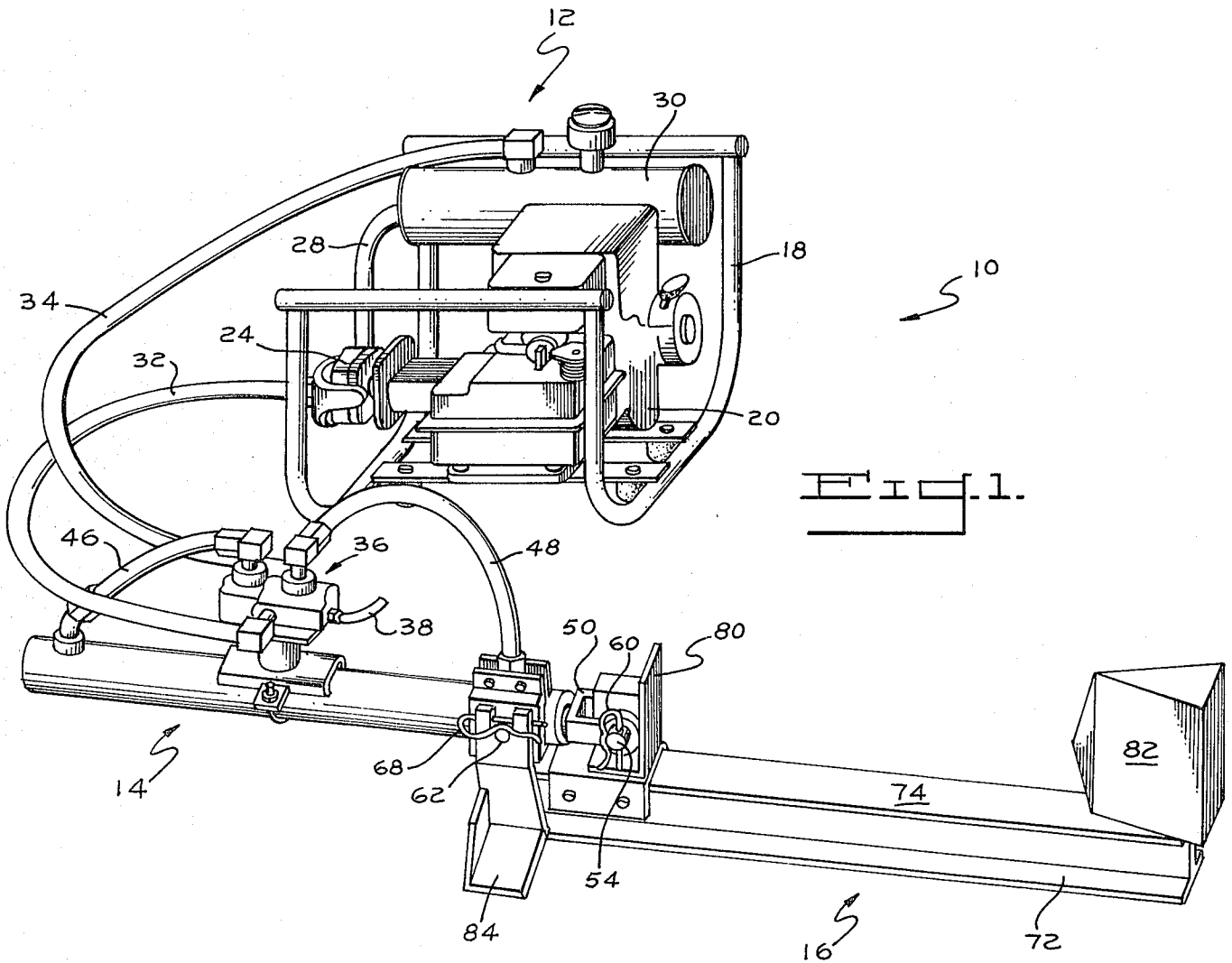
FIG. 1 is a perspective view of a portable log splitter constructed in accordance with the present invention.

Referring to the drawings in detail, FIG. 1 shows a hydraulic log splitting machine 10 that can be readily broken down into three compact and lightweight parts which can be lifted by the average adult for transport in the trunk of the family car. The machine includes an engine-pump unit or subassembly 12, a hydraulic cylinder 14, and a splitter ram unit 16.

Figure 2A:
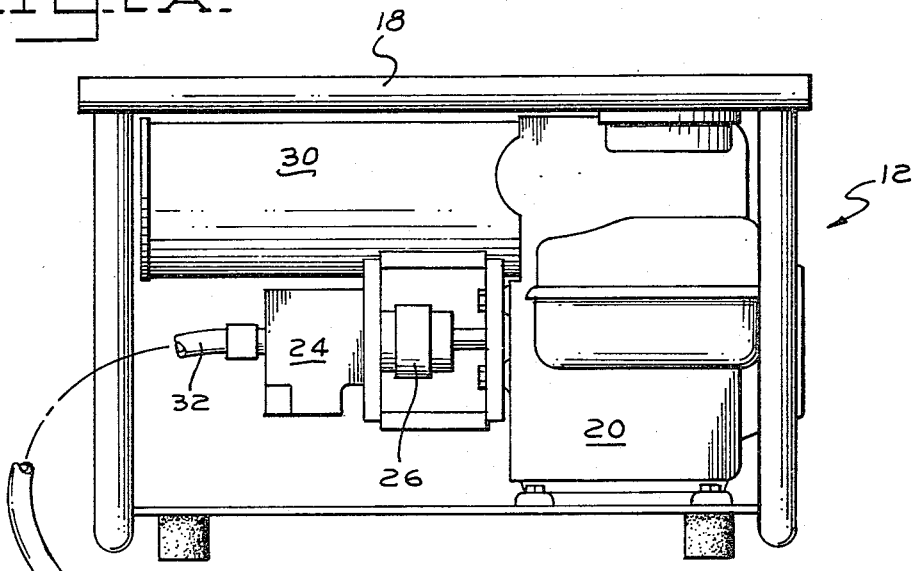
FIG. 2A is a side elevational view of the engine-pump subassembly of the splitter shown in FIG. 1.

As best shown in FIGS. 1 and 2A, the engine-pump section 12 is carried in a tubular frame or cradle 18 and includes a gasoline engine 20 of suitable horsepower, such as a 3-horsepower engine, which is connected to hydraulic rotary pump 24 by a coupling member 26. The intake side of the pump 24 is connected by a conduit 28 to a tank or hydraulic reservoir 30, which supplies the pump with a hydraulic fluid, such as a 10-weight, non-detergent oil, for pressuring the system.

Hydraulic cylinder 14 is connected to the engine-driven pump section 12 by two flexible hoses 32, 34 and includes a valve 36 which is controlled by an operating lever 38 to selectively provide pressure to opposite ends of the cylinder by means of hoses 46 and 48 for reciprocable movement of the piston. Hose 32 connects valve 36 to the high pressure side of pump 24 and hose 34 serves to return the fluid to tank 30. As shown, the valve is conveniently mounted on top of the cylinder 14 by a mounting block 42 and a U-bolt 44.

Figure 2B:
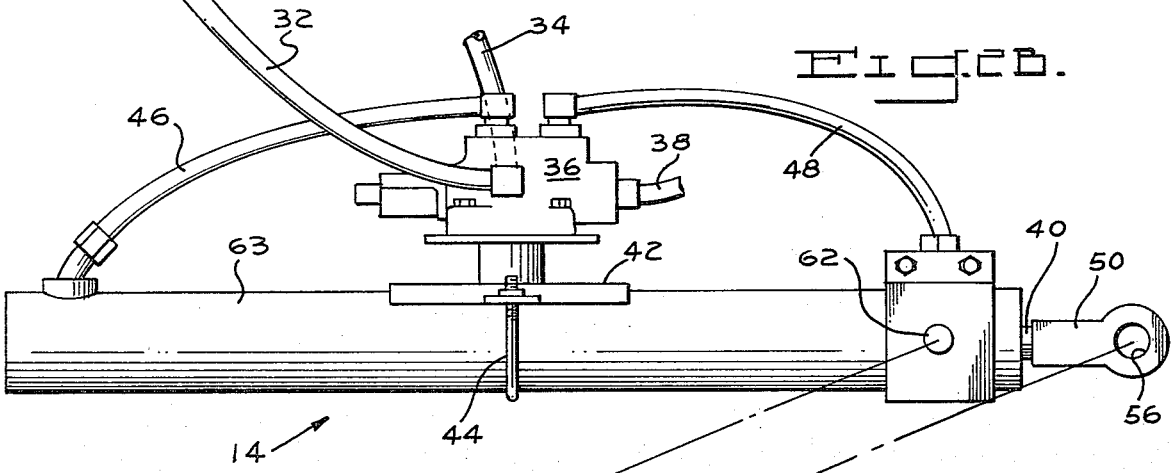
FIG. 2B is a side elevational view of the hydraulic cylinder subassembly.

Referring to FIGS. 1, 2 and 3, the cylinder may be connected to the ram unit by the use of two simple coupling pins. On the outer end of piston rod 40, a yoke 50 is provided for coupling with slide 52 of the ram unit 16 by a connecting pin 54 which fits through bores 56 registered with a hole 58 provided in an upright brace 59 which reinforces the ram plate. The connecting pin is held in place by a hitch clip or suitable cotter-type retaining pin 60. Cylinder 14 is also connected to the ram section 16 by a trunnion arrangement formed by a laterally-extending cross pin 62, the outer ends of which are adapted to fit into laterally-spaced brackets or supports 64 having upwardly-opening slots 66 to receive the pin. A pair of hitch clips 68 insertable into bores 70 provided in the upwardly extending arm portion (FIG. 3) of the brackets 64 hold the pin 62 securely in the slots 66.

Figure 2C:
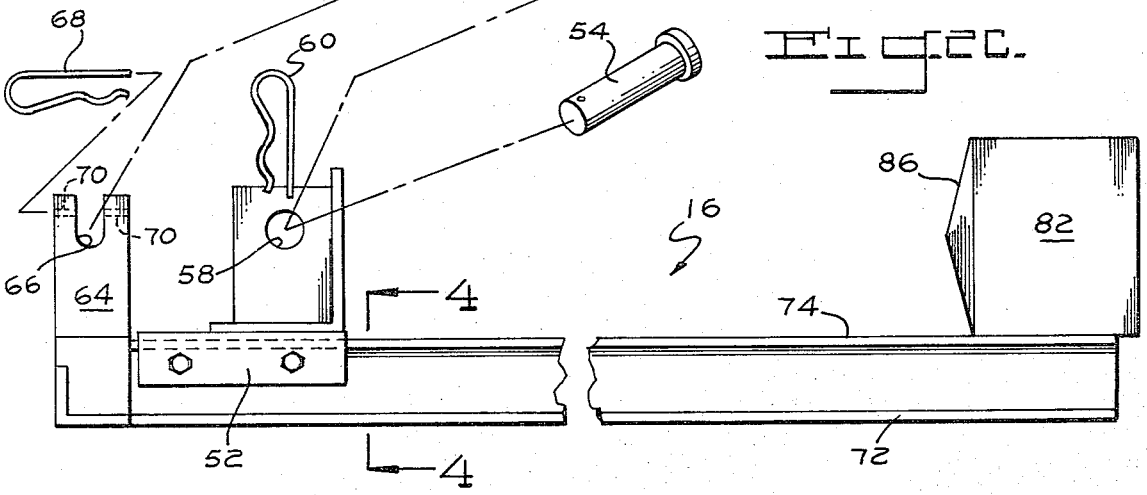
FIG. 2C is a partially exploded, side elevational view of the ram subassembly.

As best shown in FIGS. 1 and 2C, the ram section 16 includes a steel I-beam 72 with an upper flange 74 that serves as a track for slide 52. The slide 52 is generally U-shaped and is held on the beam 72 by a pair of horizontal plates 76, 78 which slidably engage the underside of flange 74. An L-shaped pusher plate 80 is mounted on the slide and is movable therewith, and is reinforced by the brace or block 59 disposed on the backside of plate 80.

A wood-splitting wedge 82 is permanently fixed to the top of flange 74, at one end of the I-beam 72. At the opposite end of the I-beam is a support base 84 with feet extending on both sides of the beam to prevent the beam from tipping or wobbling during operation of the splitter 10. In the preferred embodiment, the support base 84 and brackets 64 are an integral member.

After the three subassemblies are connected together as described in connection with FIG. 1, the engine may be started in conventional fashion and the machine readied for use. In order to split a log, the pusher plate 80 and slide 52 are first retracted using control lever 38 to the position shown in FIG. 1. The log (not shown) is then placed on top of flange 74 between the plate and the wedge with one end against ram plate 80. The lever 38 is then moved so that the piston rod 40 extends from cylinder 63 and causes the plate 80 to drive the wood against a sharp vertical edge 86 of the wedge, thereby splitting the wood.

The portable hydraulic log splitter can be easily disassembled from its FIG. 1 condition by disconnecting the hoses 46, 48 from the valve 36 and then removing the clips 60, 68, detaching the pin 54 from the yoke 50 and lifting the cylinder to remove the trunnion pin 62 from the brackets 64. Similarly, the splitter can be quickly reassembled by replacing the trunnion pin 62 into the slots 66 of brackets 64, sliding the cross pin 54 through the registered holes of the yoke 50 and slide 52 and then reattaching the clips 60, 68 and the hoses 46, 48.

In the preferred embodiment, the engine-driven pump section 12 weighs 61 pounds, the hydraulic cylinder section 14 weighs 40 pounds and the splitter ram section 16 weighs 54 pounds. Due to the lightness of the components and their easy assembly/disassembly constructional arrangement, the components can be hand-carried for ready assembly at the location of a job site. After usage, the splitter can be readily disassembled into its three main components or subassemblies and transported in the trunk of the family car.

Due to the particular assembly/disassembly arrangement of the trunnion pin 62 and brackets 64, the separable cylinder 14 and I-beam 72 are extremely compact. Note, for example, that the trunnion pin and brackets are located directly at the ends of the cylinder and I-beam so that no extension of either the I-beam length or cylinder length is necessary to mount the cylinder to the I-beam. Further, note that the outer end portions of the cylinder and I-beam are coextensive and overlap only a small amount, that amount being substantially equal to the width of the brackets. Thus, the free length of the cylinder (i.e., the portion of the cylinder that extends outwardly from the beam end) is substantially equal to its overall length and similarly, the free end of the beam (i.e., the beam portion that extends from the cylinder end) is substantially equal to its overall length. This arrangement assures a maximum stroke length of the piston rod along the beam with a minimum of overall beam length and cylinder length. And due to their compact length, the separated cylinder and I-beam can be easily transported in most car trunks and stored out of the way under benches, counters or tables.

While a preferred embodiment of the present invention has been described, it will be understood to those skilled in the art that changes and modifications may be made in the preferred embodiment without departing from the spirit of the invention. Accordingly, reference should be made primarily to the appended claims, rather than to the description of the preferred embodiment, to determine the scope of the invention.

Having thus described the invention, what is claimed is:

1. Hydraulic log splitter comprising a plurality of interconnectable subassemblies including:

a. an engine-pump unit having an engine drivingly connected to a pump and connected in fluid communication to a hydraulic reservoir;

b. a hydraulic cylinder including a double-acting piston, removably connectable to said pump section by a plurality of flexible hoses, and a piston rod reciprocably movable in response to hydraulic actuation of said piston;

c. a ram unit comprising an elongated beam having a splitting wedge disposed at one end thereof and a pusher plate slidably fitted onto said beam and removably connectable to said piston rod whereby said pusher plate is adapted to drive a log against said splitting wedge:

d. coupling means for quickly connecting and disconnecting said piston rod to said pusher plate; and, e. means for removably mounting one end of said cylinder onto the second end of said beam such that only outer end portions of the cylinder and beam are coextensive whereby the remaining free length of the cylinder is not substantially less than its overall length and the remaining free length of the beam is not substantially less than its overall length.

2. The splitter of claim 1 wherein the mounting means includes a support attached to said second beam end, said support having a width that is substantially equal to a small overlap of said outer end portions of said cylinder and beam so as to maximize the stroke length of the piston rod along the beam with a minimum of overall beam length.

3. The splitter of claim 1 wherein the mounting means comprises a trunnion arrangement formed by a laterally extending pin which is attached to said cylinder, near said cylinder end, and is adapted to fit into a pair of brackets mounted on said second beam end.

4. The splitter of claim 3 wherein the brackets comprise a pair of spaced brackets having upwardly-extending slots to removably receive the trunnion pin.

5. The splitter of claim 3 wherein the trunnion pin is held in the slots by retaining pins that are removably attached to the brackets.

6. The splitter of claim 1 wherein the coupling means comprises a yoke and pin arrangement.

7. The splitter of claim 6 wherein said yoke is attached to said piston rod and the cross pin is removably insertable into registrable holes of said yoke and pusher plate.

8. The splitter of claim 1 wherein a valve to control the hydraulic actuation of said piston is mounted on said cylinder.

* * * * *